US006227796B1

(12) United States Patent
Markovitch

(10) Patent No.: US 6,227,796 B1
(45) Date of Patent: May 8, 2001

(54) CONICAL STACKED-DISK IMPELLER FOR VISCOUS LIQUIDS

(76) Inventor: Peter T. Markovitch, 2021-28 Ave N.W. Apt. #4, Calgary, Alberta (CA), T2M 2L7

( * ) Notice: Subject to any disclaimer, the term of this patent is extended or adjusted under 35 U.S.C. 154(b) by 0 days.

(21) Appl. No.: 09/369,376

(22) Filed: Aug. 6, 1999

(51) Int. Cl.[7] ..... F03B 5/00

(52) U.S. Cl. ..... 415/90; 415/73; 415/199.1; 416/4; 416/198 A; 416/201 R; 416/223 B

(58) Field of Search ..... 415/72, 73, 90, 415/199.1, 199.2, 199.3; 416/4, 198 A, 201 R, 223 B

(56) References Cited

U.S. PATENT DOCUMENTS 4,548,545 * 10/1985 Lewis et al. ..... 415/90
5,419,679 * 5/1995 Gaunt et al. ..... 415/90

OTHER PUBLICATIONS

Derwin abstract of the Canadian application No. 2,185,176, Mar. 1998.*

* cited by examiner

*Primary Examiner*—F. Daniel Lopez
*Assistant Examiner*—Ninh Nguyen
(74) *Attorney, Agent, or Firm*—Gowling Lafleur Henderson LLP

(57) ABSTRACT

One or more improved pump impellers are provided and are rotationally supported in a pump having one or more stages. The improved impeller comprises a fluid induction core of flow passages spiraling axially about the impellers rotational axis and a stack of circular disks extending radially and concentrically from the induction core. The stack of disks is preferably a frusto-conical stack with the disks at the downstream end of the impeller having a lesser radial extent than do the upstream disks so that incrementally less fluid issues from each successive radial flow passage between adjacent disks thereby reducing head loss in the issuing viscous fluid flow and increasing pumping efficiency. Increased pump efficiency permits one to provide a conical pump housing profile about each impeller which corresponds with the conical stack, thereby diminishing the fluid flow area and increasing the discharge pressure and flow capacity of each pumping stage.

6 Claims, 5 Drawing Sheets

CONICAL STACKED-DISK IMPELLER FOR VISCOUS LIQUIDS

FIELD OF THE INVENTION

This invention relates to improvements to a pumping apparatus for handling viscous liquids, such as heavy oil which is extracted from underground oil bearing stratum.

BACKGROUND OF THE INVENTION

The extraction of heavy oil bitumen from an underground "reservoir" presents significant handling problems, by reason of the high viscosity of bitumen, and the presence of other liquids, gases and even solid particles in fluid admixture with the bitumen. Conventionally, pumping action is carried out using bladed impellers or vane-type pumps which pump the fluid to surface installations where subsequent separation of the fluid into its constituent parts takes place. High viscosity of bitumen, use of steam injection to lower the bitumen viscosity and abrasive materials result in many difficulties including solids impingement wear, and cavitation leading to pumping inefficiencies and incipient pump failures.

In a co-pending Canadian Patent Application No. 2,185,176, published on Mar. 11, 1998, the inventor previously disclosed a prior pump for handling viscous liquids, such as heavy oil bituminous fluid mixtures, and which overcomes some of the limitations of conventional vaned pumps. The inventor's prior pump utilizes a composite impeller "the prior impeller" having a stack of thin disks positioned concentrically over a cylindrical core. The disks are parallel and are spaced axially along the core. The core is formed with a plurality of upwardly spiraling vanes. The radial periphery of the core between vanes is open for fluid communication to the spaces between the disks. The core has a fluid inlet at one end of the vanes and fluid discharges at the periphery of the disks. The prior impeller is located concentrically within a cylindrical housing, forming an annular flow chamber therebetween. This stack of disks and the housing each have a cylindrical profile. In pumping operation, the core and disks are rotated. Boundary layer drag between pumped fluid and the rotating disks and centripetal force drives the fluid radially outwards to discharge at the disks' periphery and into the annular flow chamber. Fluid exiting the disks inducts fluid from the core's spiral vanes and from the previous impeller stage or pump intake.

A multiplicity of vortices are formed in the annular flow chamber. Like a centrifuge or cyclone, the fluid can separate into at least some of its separate component parts or phases, more dense fluid, such as contained solids, being driven outwardly. The vortices result in very unfavorable intake conditions should the fluid in the flow chamber be routed into the intake of a successive pumping stage. A stationary vane diffuser is applied between pumping stages. The prior impeller, while improving pumping capacity and performing primary separation, results in two phenomenon which are disadvantageous; high wear of the pump housing, particularly at the exit of the annular flow chamber, and high back-pressure at the impeller discharge which limits flow capacity.

At each downstream increment of the annular flow chamber, greater and greater accumulated flow is experienced. The accumulated flow results from each incremental increase in fluid exiting from each successive planer disk of the impeller. The linear increment in fluid discharge results in the development of back-pressure which affects the accumulating flow. Additionally, the combination of the incremental linear fluid discharge, the concentration of solids at the periphery of the flow chamber and turbulence results in high wear at the discharge of the flow chamber. The turbulence, the formation of discharge back-pressure and the housing wear result in reduced pump performance and increasing pumping inefficiencies.

This prior impeller is an improvement over other conventional impellers, and produces higher throughput and capability for handing mixtures including solids. However side effects, such as high housing wear, is an undesirable characteristic and, further, because multistage pumping can incorporate several hundred stages, the losses and back-pressure associated with each stage can be significant.

SUMMARY OF THE INVENTION

An improved impeller is provided for a viscous fluid pump, said impeller providing several advantages over even the inventor's own prior art. In a preferred form, the improved impeller comprises a plurality of radially extending and axially spaced conical stack of ever diminishing diameter disks for providing ever diminishing incremental flow therefrom. Surprisingly, when compared to the prior art cylindrical stack of disks, all of which have the same diameter, the improved impeller produces greater flow despite its reduced ability to induce flow. Instead, in one implementation, a conical impeller having 16% reduced flow induction capability but much reduce head losses can actually provide about 30% more throughput over the prior stacked-disk impeller design without an increase in power requirements. Additionally, high impeller housing wear is markedly reduced. The observed improvements are hypothesized to be due to the manipulation of the flow patterns at the radial periphery of the impeller so as to significantly reduce head losses in the annular flow chamber, particularly by the minimizing of flow turbulence and back-pressure for each successive disk and at the discharge of the annular flow chamber.

Accordingly, in a broad aspect of the invention, an improved pump impeller for viscous fluids is provided, the impeller having a rotational axis, an upstream end, a downstream end and a plurality of parallel flow passages spiraling axially about the rotational axis, the axial flow passages being open at the upstream end and blocked at the downstream end, the impeller being concentrically and rotationally supported within a housing for forming an annular flow passage between the radial extent of the impeller and the radial extent of the housing, the improvement comprising:

a stack of circular disks wherein each disk extends radially and concentrically from the spiral flow passages and is spaced axially from each other disk for forming a plurality of radial flow passages which communicate with the spiral flow passages so that fluid flows from the impeller's upstream end, through the spiral flow passages and is distributed into the radial flow passages; and the disks at the downstream end have a lesser radial extent than do the upstream disks so that incrementally less fluid issues from the radial flow passages between disks at the impeller's downstream end is less than that which issues from the radial flow passages at the upstream end and thereby minimizing head losses in the resulting flow.

Preferably, the radial extent of successive disk is linearly diminishing for forming a frusto-conical profile of disks between the upstream and downstream ends.

The improved impeller is particularly suited for providing an improved viscous fluid pump comprising:

a rotatable impeller having a plurality of parallel flow passages spirally axially about its rotational axis and a stack of circular disks mounted concentrically therearound, each disk extending radially and concentrically from the axial flow passages and being spaced axially from one another for forming a plurality of radial flow passages therebetween, each downstream disk having a smaller outside diameter than the preceding upstream disk, the radial flow passages being in communication with the axial flow passages so that fluid flows from the impeller's upstream end, through the axial flow passages and is issued into the radial flow passages, the incremental flow of fluid issuing from the radial flow passages at the downstream end being is less than that issuing from the upstream end; and a housing which rotationally supports the impeller therein for forming an annular flow passage therebetween, the annular flow passage receiving and conducting the flow of fluid incrementally issuing from the radial flow passages.

Preferably, the stack of diminishing diameter disks has frusto-conical profile and the annular flow passage has a diminishing cross-sectional area, more preferably having a profile corresponding to the conical disk profile.

More preferably, the pump comprises a plurality of improved impellers, provided in a co-axial arrangement of pumping stages, and a stationary vane diffuser is positioned between each stage, the diffuser inlets preferably being located adjacent the previous stages furthermost downstream impeller for furhter minimizing head loss.

BRIEF DESCRIPTION OF THE DRAWINGS

FIG. 3*a* is a partial perspective view from above, showing cutaway views of the top and bottom disks for illustrating the induction core, intermediate disks not being illustrated: FIG. 3*b* is a bottom view according to FIG. 3*a.

DETAILED DESCRIPTION OF THE PREFERRED EMBODIMENT

Figure 1:
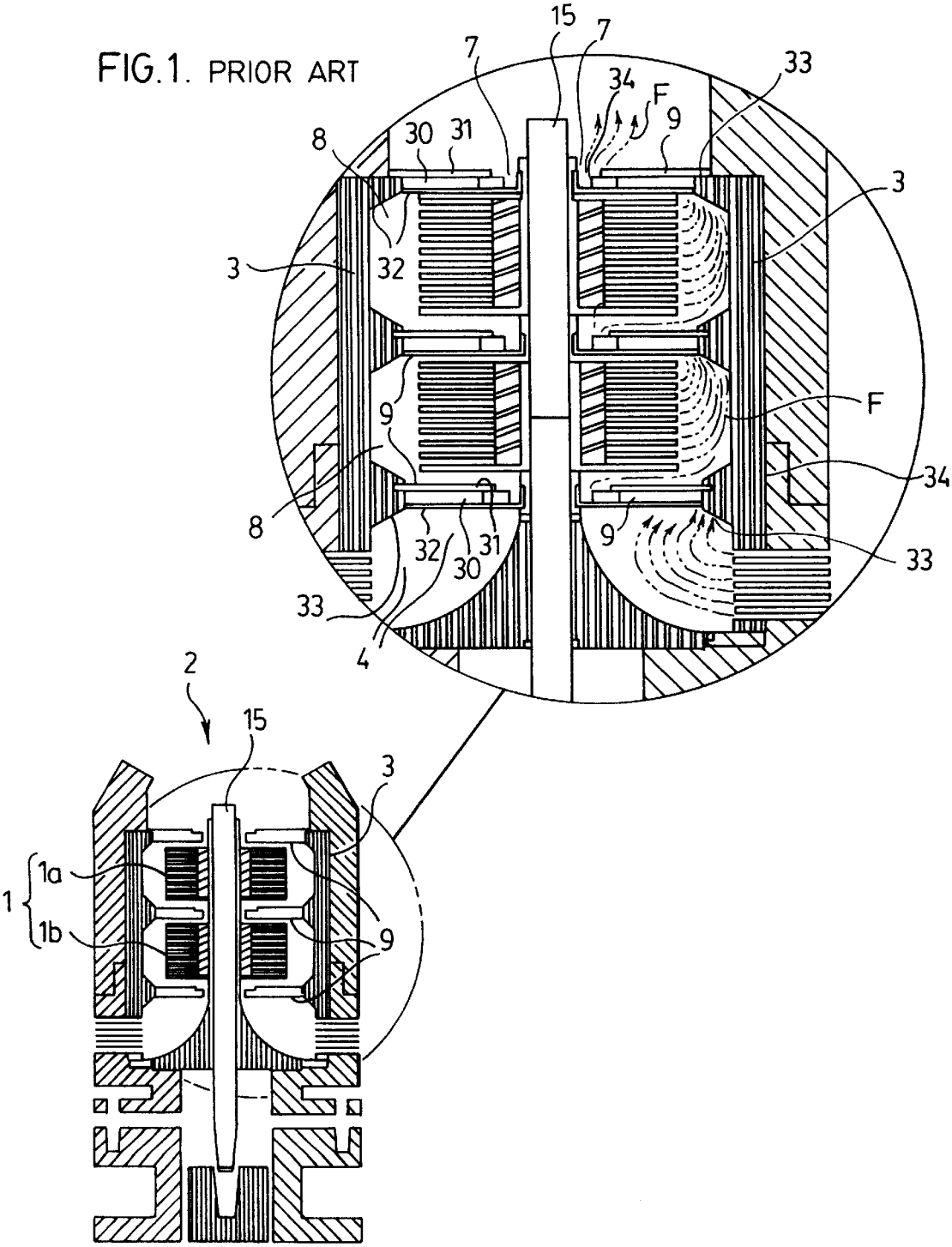
FIG.1. PRIOR ART
FIG. 1 is a partial cross-sectional illustration of a multistage pump implementing two stages of prior art impellers with a detail balloon of the flow paths of fluid through the pump.

Having reference to FIG. 1, a plurality of impellers 1 are provided for implementation in a conventional multistage pump 2. Typically, the pump 2 is located within a subterranean well (not shown) for lifting viscous heavy oil to the ground surface.

In a typical vertical well implementation, the rotational axis of the pump 2 is arranged vertically in the well. Accordingly, for convenience and ease of reference, the orientation of the pump axis, its components and fluid flow may be referred as being vertically arranged with the fluid moving upwardly. The pump can then be described as having a lower upstream end and an upper downstream end, although it is understood that the axis may also lie in other orientations without limiting the scope of the invention.

The pump 2 comprises cylindrical housing 3 having an intake 4 at or near its lower end 5 to receive viscous fluid, and an upper discharge 6 at its upper end 7 from which the fluid issues for lifting to the surface.

As shown in FIG. 1, positioned within a pump 2 are two or more prior art impellers 1*a,* 1*b,* rotatably and co-axially mounted in the housing 3 and forming an annular flow passage 8 therebetween. When rotated at high speeds, the impellers 1*a,* 1*b* generate an upward flow of fluid F which rotates within the annular flow passage 8 about the axis of the housing 3. Diffusers 9 are positioned between each impeller 1*a*–1*b* for separating the pump 2 into stages. Impeller 1*a,* the lowest in the pump 2 and forming the first stage, induces inward flow F of the fluid into the pump's intake 4 and then directs fluid through a diffuser 9 to the next stage, being the intake of the next impeller 1*b.*

The prior art impellers 1*a,*1*b* and the novel improved impeller 10, shown in FIGS. 2 and 3*a*–3*c* both comprise a central induction core 11 and a stack 12 of disks 13. In FIG. 1, each of the inventor's prior art disks 13 of impellers 1*a,* 1*b* can be seen to be substantially identical, each having the same outer diameter for forming a cylindrical stack 12. The improved impeller 10 implements a modification of the impeller disks 13 and may be combined with a corresponding modification to the housing 3.

Figure 2:
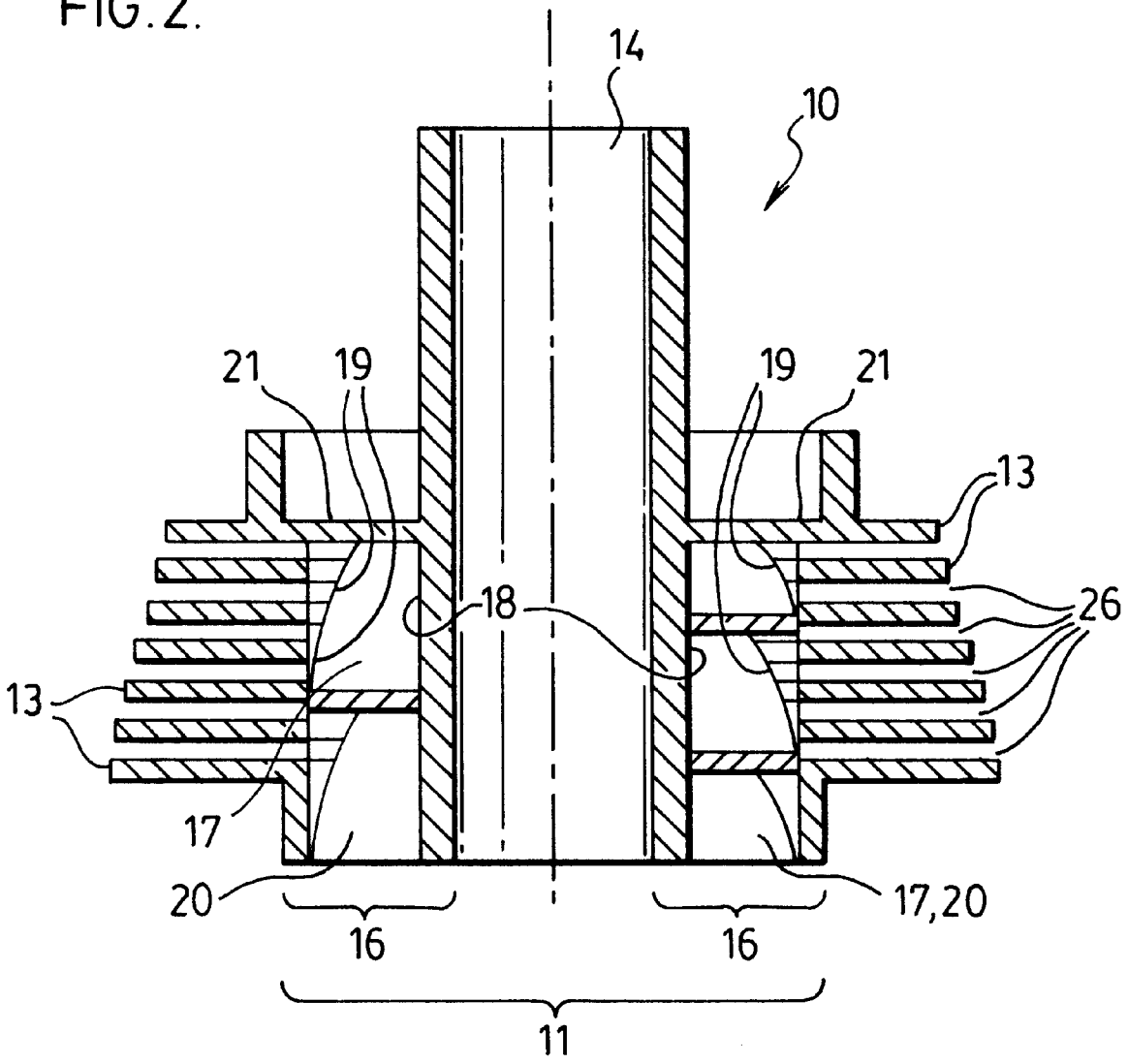
FIG. 2 is a cross-sectional view of an improved impeller.
Figure 3A:
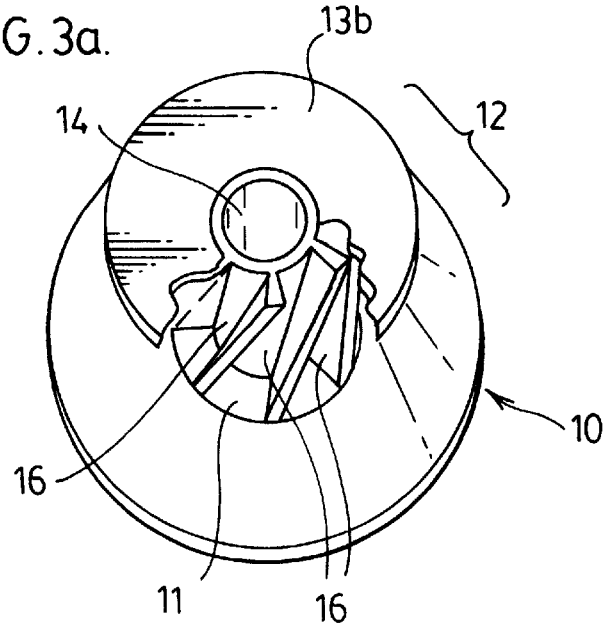
FIGS. 3*a,* 3*b* and 3*c* are various views of an improved impeller. More particularly.
Figure 3B:
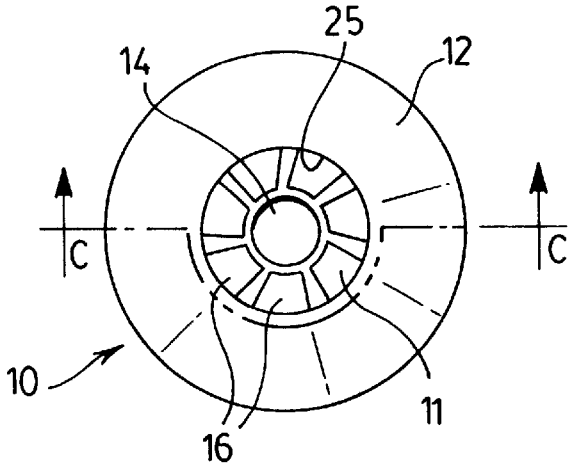
Figure 3C:
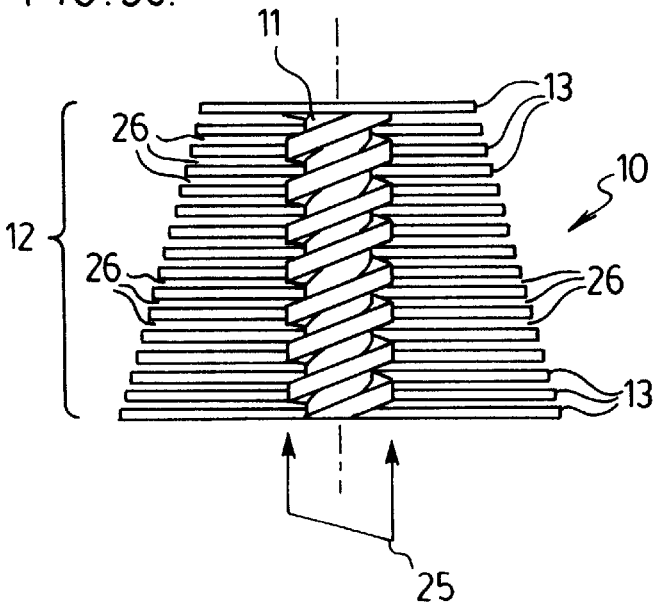
* and FIG. 3*c* is a cross-sectional side view along line C—C of FIG. 3*b.;*

Turning to FIG. 2, the improved impeller 10 also comprises a plurality of disks 13, but the diameter of the disks 13 for each disk spaced in the axial direction. The novel impeller's disks 13 are ever smaller in diameter in the direction of fluid flow, or downstream.

More particularly, the improved impeller's induction core 11 is a cylindrical body having a central bore 14 for accepting the pump's driving shaft 15 (FIG. 1). The body forms an annular wall 16 about bore 14. A plurality of parallel slots 17 are formed in the annular wall which spirally advance about the body's axis. The slots form axial fluid flow passages. The slots inside radius 18 is closed at the bore and the slot's outside radius 19 is open. The slots 17 are open at the lower end of the core's body to form fluid intakes 20. The slots 17 are blocked at the core's upper end 21 so as to prevent axial exit of fluid from the axial flow passages 17. The number of slots 17 (seven slots shown in FIGS. 3*a,*3*b*) and angle of advance from the axis can be varied in response to the viscosity of the fluid being pumped. Flatter angles (greater angle measured from the axis) are used in the case of more viscous fluid. For example, in tests with a bituminous heavy oil of viscosity orders of magnitude greater than that of water, slot angles of about 60° measured from the impeller's axis were found to be suitable.

The stack 12 comprises a plurality of disks 13 extending normal to the pump's axis, each of which has a central opening 25 which is arranged concentrically about the induction core 11. The uppermost disk 13*b* is fitted to the induction core's inner wall 18 for blocking the upper axial end of the slots 19. The central openings of the remaining disks 13 are fitted to the outer radius 19 of the core's annular wall. The bottommost disk 13*a* delineates the slot's fluid inlets 20. Intermediate and adjacent disks 13 are spaced axially apart to define fluid flow passages 26 therebetween.

The stack 12 of disks co-rotates with the induction core 11, specifically being mounted at their central openings 26 to the induction core 11.

Rotation of the impeller 10 imparts energy into the fluid in the radial flow passages 26, sandwiched between the spaced disks 13. Boundary layer drag/viscosity drag on the facing and spaced disks 13 exert a tangential force on the fluid and centripetal forces exert a radial force on the fluid. A stationary boundary layer separates the moving fluid and the facing surfaces of each disk 13 and thus there is little erosion or abrasion of the disks even when pumping the most abrasive slurries.

The drag on the fluid between disks 13 induces a radial and circumferential movement in the fluid, resulting in a helical path flow path radially outwardly to the annular flow passage formed between the impeller 10 and housing 3. The fluid eventually discharges from between the spaced disks, causing a low pressure between the radial flow passages 26 and the induction core's slots 17. Fluid is prevented from leaving the upper end of the slots at 21 and thus must move radially outward from the slots 17 and through the radial flow passages 26, enabling a continuous flow process.

As stated, the fluid leaves the disks 13 radially and circumferentially. Fluid flows generally upwardly F through the pump and up the annular flow passage 8. Between stages, fluid flow F is redirected radially inwardly again to reach the fluid inlets 20 of the next stage immediately above. In order for successive pump stages to act cumulatively, this must be carried out as smoothly and efficiently as possible. Radial redirection is required because, as in any multistage pump application having axially stacked centrifugal impeller stages, exiting fluid from ore stage must be delivered to the next stage's intake. More particularly, using a disk impeller, vortices must be quieted before the successive impeller intake.

Accordingly, a diffuser 9 is positioned between stages for drawing fluid from its outer circumference and driving it radially inwardly to the intake 20 of the next stage. In this way the kinetic energy of the fluid is exchanged for static pressure.

The diffuser is a device known to those having experience in the multistage pump art and is not detailed in this disclosure. As shown in FIG. 1, each diffuser 9 comprises a plurality of stationary and inwardly spiraling vanes 30 located between top and bottom plate structures 31,32 of the pump 2. The bottom plate 32 has a lesser diameter than the housing 3 for forming an peripheral intake 33 so that fluid is admitted at its outer circumference. Fluid is constrained by the top plate 31, engages the diffuser vanes 32 and is driven spirally inwardly. The top plate 31 has a concentric hole 34 at its center for discharging the re-directed fluid at the induction core 11 of the next stage.

There is an energy loss associated with the flow of fluid F through the annular flow passage 8 due to head losses. These losses reduce the pumping efficiency and the incremental pressure increase achieved for that stage, dependent on many factors including inlet conditions, the angle of divergence, degree of pipe friction present and the eddies formed in the flow F.

Figure 4:
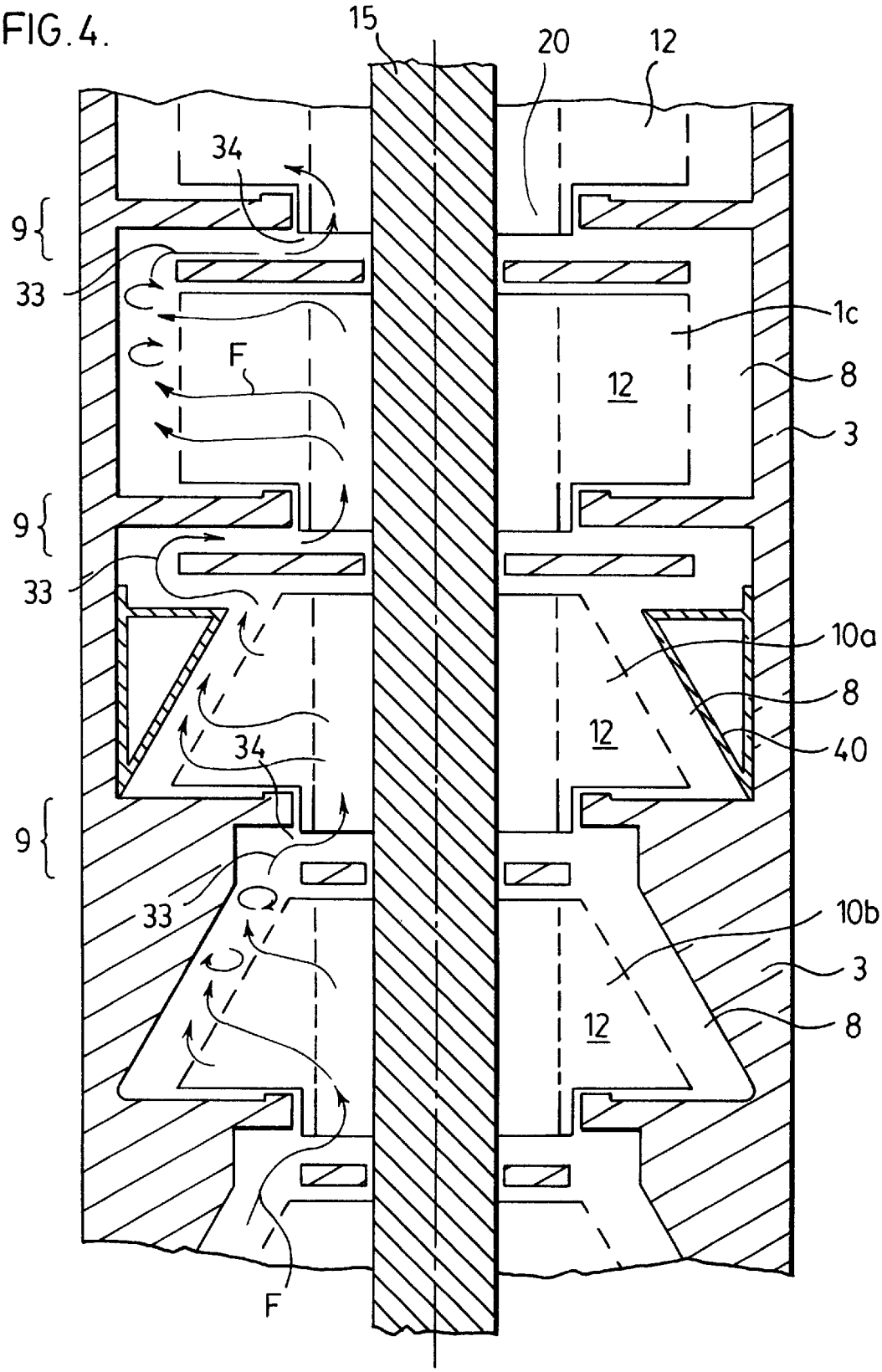
FIG. 4 is a partial cross-section simplified view of three impellers on a pump shaft; a prior art impeller, an improved impeller constructed according to one embodiment of the invention implemented in a conventional cylindrical housing fitted with a conical sleeve, and the improved impeller in a modified conical housing.

Turning to FIG. 4, a combination of different impellers 1*c*, 10*a*, 10*b* are combined in a single pump for economic illustrative purposes only. Correspondingly, the inside diameter of the housing 3 may also vary for manipulating the annular flow passage 8 between the radial extent of the disks 13 and the housing 3.

A first prior art cylindrical disk impeller 1*c* is shown located at the top of FIG. 4. Second and third impellers 10*a*,10*b* are also shown, being improved impellers 10 according to FIG. 2, and are located immediately below impeller 1*c*.

Diffusers 9 are provided between each impeller 1*c*–10*a* and 10*a*–10*b*.

The housing 3 about impeller 10*a* is conventionally cylindrical but is modified using a conical sleeve 40 for providing a narrowing annular flow passage 8 for increasing the stage's discharge pressure. The diffuser 9 is unchanged from that used for impeller 1*c*.

Both the housing 3 about impeller 10*b* and the diffuser 9 thereabove are shown modified for providing a narrowing annular flow passage 8 and for providing a less tortuous path for fluid flow F.

Figure 5A:
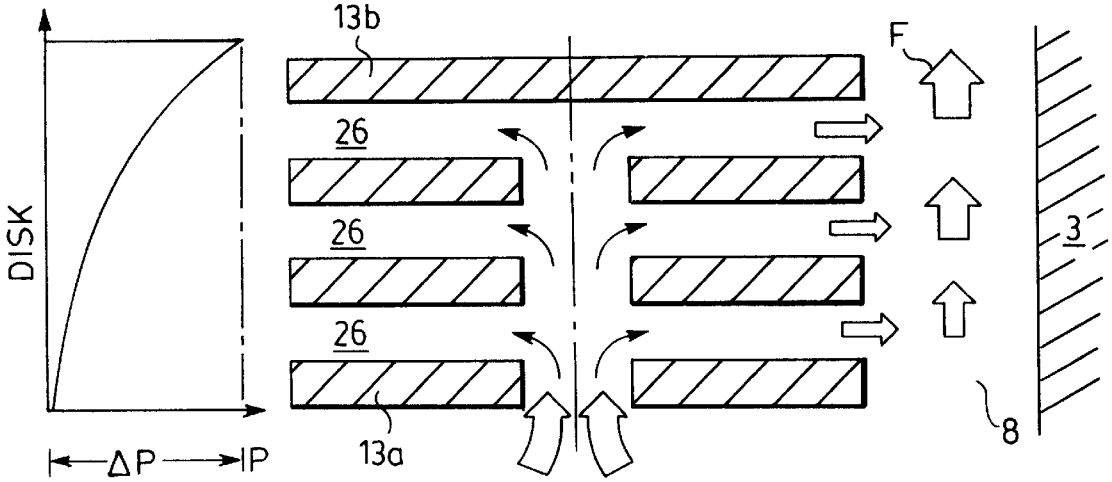
FIG. 5a. PRIOR ART
FIGS. 5*a* and 5*b* are diagrammatic views of a prior art cylindrical impeller and an improved conical impeller for fanciful illustration of the magnitude of the flows therefrom and head loss.
Figure 5B:
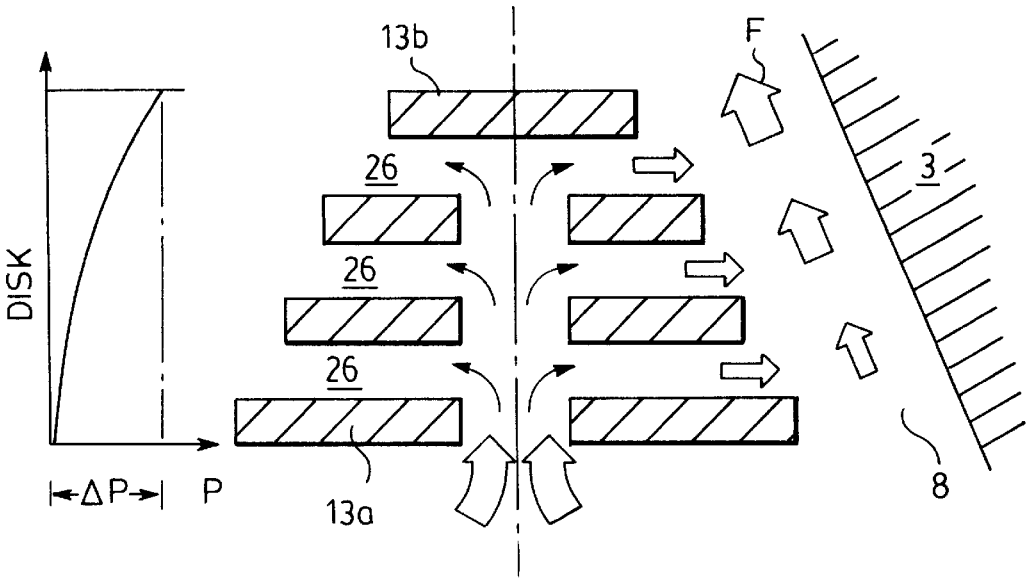

Referring to FIGS. 5*a*,5*b*, a fanciful illustration is provided in which the performance of the prior art impeller is compared to the improved impeller respectively. In FIG. 5, a flow rate of one unit is represented by one sketched line and a combined flow rate of 12 units is 12 sketched lines. Further, the developed head loss is illustrated on a corresponding graph at left.

What is demonstrated is that the prior art impeller 1 (FIG. 5*a*), while it is theoretically capable of greater per disk flow rates F than the improved impeller 10 (FIG. 5*b*), the practical result is that improved impeller 10 can provide as much or even greater flow due to reduced head loss or pressure drop. More particularly, in the prior art case of FIG. 5*a*, each of the radial flow passages 26 are depicted as passing 4 units of flow. With minimal head loss, each disk is deemed to theoretically pass 5 units of flow F. In the annular flow passage 8, the fluid flow combines for 4, 8 and finally 12 total units of flow F. Due to head losses caused by turbulence and rising back-pressure in the annular flow passage 8, the theoretical 5 unit flow for each radial flow passage 13 is shown as resulting in a total of only 12 units and not 15 units. The head loss is depicted as increasing at an increasing rate due to the increasing interference in flows in the annular flow passage 8 as high radial flow impinge on the accumulating fluid flow.

Turning to the improved impeller 10 of FIG. 5*b*, the radial flow passages 26 of downstream disks have decreasing theoretical flow rates. However, due to the reduced head losses resulting from use of the improved impeller 10, the actual fluid flow rate F is depicted as being nearly equal to the theoretical rates of 5, 4 and 3 units for each successive downstream passage 26 respectively. Accordingly, in the annular flow passage 8, the fluid flow combines for 5, 9 and finally 12 total units of flow F. The head loss is depicted as significantly reduced.

As a result of obtaining a reduced head loss across the impeller, then more pressure can be achieved across the stage. One approach to achieving greater pressure is to constrict the annular flow passage. As shown fancifully in FIG. 5*b*. and more practically in FIG. 4, the radial extent of housing 3 can be correspondingly diminished as do the downstream impeller disks.

In one field test performed in a well having 17 API heavy oil and 0.5% solids, a 180 stage pump using conical disk impellers and housing sleeves achieved 30% more flow than a previous implementation using cylindrical disk impellers. Each impeller had seven 1/16" thick disks, each spaced about 1/16" apart for forming 6 radial flow passages. The bottommost disk was about 3 1/16" diameter and the uppermost disk was about a 2 5/8" diameter with a linear profile therebetween. The induction core had a 1 3/4 outside diameter, a 15/16" inner diameter and a shaft bore for accommodating an 11/16"

driveshaft. Seven axial flow passages were provided formed with a 60° advance. The boundary drag surface area provided by the conical disks was only 84% of the area which was provided by a prior art cylindrical profile impeller of the identical other parameters yet was able to pump about 30% more fluid without an increase in the power to drive the pump. At 4000 rpm the pump was capable of 123 $m^3$ per day of fluid flow.

The embodiment of the invention for which an exclusive property or privilege is claimed are detailed as follows:

1. A pump impeller having a rotational axis, an upstream end, and a downstream end comprising:

a plurality of parallel flow passages spiraling axially about the rotational axis, the axial flow passages being open at the upstream end and blocked at the downstream end; and a stack of circular disks, each disk extending radially and concentrically from the axial flow passages and being spaced axially from each other disk for forming a plurality of radial flow passages which communicate with the axial flow passages so that fluid flows from the impeller's open upstream end, through the axial flow passages and into the radial flow passages, wherein the disks at the downstream end have a lesser radial extent than do the upstream disks so that incrementally less fluid issues from the radial flow passages between disks at the impeller's downstream end than that which issues from the radial flow passages at the upstream end.

2. The improved impeller as recited in claim 1 wherein the radial extent of successively downstream disks is linearly diminishing for forming a frusto-conical profile of disks between the upstream and downstream ends.

3. An improved pump for pumping viscous fluids implementing comprising:

an impeller having a rotational axis, an upstream end, a downstream end and a plurality of parallel flow passages spiraling axially about the rotational axis, the axial flow passages being open at the upstream end and blocked at the downstream end;

a stack of circular disks, each disk extending radially and concentrically from the axial flow passages and being spaced axially from each other disk for forming a plurality of radial flow passages which communicate with the axial flow passages so that fluid flows from the impeller's open upstream end, through the axial flow passages and into the radial flow passages, wherein the disks at the downstream end have a lesser radial extent than do the upstream disks so that incrementally less fluid issues from the radial flow passages between disks at the impeller's downstream end is less than that which issues from the radial flow passages at the upstream end; and a housing in which the impeller is concentrically and rotationally supported, an annular flow passage being formed between the radial extent of the impeller and the housing for receiving and conducting the flow of fluid incrementally issuing from the radial flow passages.

4. The improved pump as recited in claim 3 wherein the radial extent of the successively downstream disks is linearly diminishing for forming a frusto-conical stack of disks between the upstream and downstream ends; and the housing has a radial extent which has a diminishing radial extent corresponding to the impellers stack of conical disks.

5. The improved pump as recited in claim 3 further comprising a plurality of improved impellers, provided in a co-axial arrangement of successive pumping stages; and a plurality of stationary vane diffusers, one positioned between each stage.

6. The improved pump as recited in claim 5 wherein each diffuser has peripheral inlet located adjacent the outer circumference of the furthermost downstream disk of an impeller of an upstream stage and an outlet located adjacent the axial flow passages of the impeller of the next successive downstream stage.

* * * * *